United States Patent [19]

Steiner

[11] Patent Number: 4,487,233

[45] Date of Patent: Dec. 11, 1984

[54] MULTIPLE LONGITUDINAL TRAVERSING SHED WEAVING LOOM

[75] Inventor: Alois Steiner, Rieden, Switzerland

[73] Assignee: Maschinenfabrik Sulzer-Rüti AG, Rüti, Switzerland

[21] Appl. No.: 483,526

[22] Filed: Apr. 11, 1983

[30] Foreign Application Priority Data

Apr. 28, 1982 [CH] Switzerland ..... 2588/82

[51] Int. Cl.[3] ..... D03D 47/00; D03C 13/00

[52] U.S. Cl. ..... 139/28; 139/11; 139/55.1; 139/191

[58] Field of Search ..... 139/190, 191, 188 R, 139/28, 48, 11 A, 436, 55.1

[56] References Cited

U.S. PATENT DOCUMENTS

| | | | |
|---|---|---|---|
| 3,848,642 | 11/1974 | Steiner | 139/11 A |
| 4,285,370 | 8/1981 | McGinley | 139/11 A |
| 4,291,729 | 9/1981 | Steiner | 139/28 |
| 4,351,367 | 9/1982 | McGinley | 139/11 A |

FOREIGN PATENT DOCUMENTS

| | | | |
|---|---|---|---|
| 2645302 | 12/1977 | Fed. Rep. of Germany | 139/11 A |
| 732546 | 6/1932 | France | 139/48 |
| 40191 | 7/1965 | German Democratic Rep. | 139/28 |
| 277634 | 12/1970 | U.S.S.R. | 139/11 A |

*Primary Examiner*—James Kee Chi

*Attorney, Agent, or Firm*—Werner W. Kleeman

[57] ABSTRACT

A weaving rotor carries lamellae combs, the lamellae of which are provided with shed-retaining elements. Shedding rods which are stroke-wise displaceable in the warp direction are positioned forwardly of the weaving rotor to allocate each warp thread to a shed-retaining element determining either an upper shed or a lower shed. The shedding rods are formed by first racks, the tooth spaces or gaps of which serve as guide means for the warp threads. Thus, there is ensured as precisely as possible pitch or division of the guide means for the warp threads as well as an accurate reproducibility for the shedding rods. The lamellae are positioned on the weaving rotor by second racks having the desired pitch. The first and second racks correspond to each other and are identically designed. Consequently, there results the highest conformity between the lamellae pitch and the pitch of the warp threads, and thus, an optimally ordered run or course of the warp threads from the shedding rods to the weaving rotor. Additionally, manufacture and operation of the multiple longitudinal traversing shed weaving loom are rendered more economical.

8 Claims, 6 Drawing Figures

MULTIPLE LONGITUDINAL TRAVERSING SHED WEAVING LOOM

CROSS-REFERENCE TO RELATED APPLICATION

This application is related to my commonly assigned, copending U.S. application Ser. No. 483,527, filed Apr. 11, 1983, entitled "Lamellae Comb for Weaving Apparatus, Particularly for a Weaving Rotor in a Multiple Longitudinal Traversing Shed Weaving Loom, and Method for Manufacturing the Same".

BACKGROUND OF THE INVENTION

The present invention relates to a new and improved construction of multiple longitudinal traversing shed weaving apparatus or loom.

In its more specific aspects the invention relates to a new and improved multiple longitudinal traversing shed weaving loom comprising a weaving rotor containing shed-retaining elements for holding the warp threads over a predetermined path in selective upper and lower shed positions, and further including control means arranged forwardly of the weaving rotor with respect to the direction of travel of the warp threads. The control means serve to laterally deflect and allocate each warp thread to a respective one of the shed-retaining elements determining either an upper shed or a lower or bottom shed and including shedding rods which extend in the weft direction and are displaceable by an adjustable stroke in such weft direction.

In a multiple longitudinal traversing shed weaving loom as known, for example, from U.S. Pat. No. 4,291,729, granted Sept. 29, 1981, the shedding rods are provided with guide eyelets for the warp threads. It has been found that during the manufacture of such shedding rods, particularly with respect to the attachment of the guiding eyelets for the warp threads, again and again irregularities occur in respect of the mutual distance, the so-called pitch or division, of the guide eyelets. Such irregularities lead to two undesired disadvantages. In the first instance, they cause the warp threads not to run strictly parallel to each other from the shedding rods to the weaving rotor. Thus, the correct introduction of the warp threads into the weaving rotor is rendered substantially more difficult. In the second instance, the irregularities add up to a sum or summation error across the weaving or fabric width which, with a usual weaving width of about 2 meters, is in the order of magnitude of millimeters.

Considering that fabrics having a density of up to 40 warp threads per centimeter and more are intended to be produced on a multiple longitudinal traversing shed weaving loom of such kind, it will become evident that a sum error of the order of magnitude as mentioned may result in the warp threads guided by the different shedding rods not being ordered in their correct mutual association and not being in their correct association to the weaving rotor at the location where they are introduced into the weaving rotor. In practice this means, however, that the warp threads are incorrectly introduced into the weaving rotor and that a defective fabric is produced.

SUMMARY OF THE INVENTION

Therefore, with the foregoing in mind it is a primary object of the present invention to provide a new and improved multiple longitudinal traversing shed weaving apparatus or loom in which faultless introduction of the warp threads into the weaving rotor is ensured.

Another and more specific object of the present invention is directed to the provision of a new and improved multiple longitudinal traversing shed weaving loom in which no irregularities occur between the guide means for the warp threads and, in which, specifically, sum errors of the kind mentioned no longer occur.

Now in order to implement these and still further objects of the invention, which will become more readily apparent as the description proceeds, the multiple longitudinal traversing shed weaving loom of the present development is manifested by the features that, the shedding rods are formed by first racks, the tooth spaces or gaps of which serve as guiding means or guides for the warp threads.

As known, such racks are produced by using special machine tools, so that the accuracy of the tooth pitch thereof is vastly superior to the pitch of the guide eyelets on the known shedding rods. It may thus be safely assumed that the aforementioned irregularities and nonconformities no longer occur. Specifically, any summation error is precluded and at most deviations only could occur within the individual tooth pitches due to the machine tool as such. In any case such deviations would be negligibly small. Furthermore, they would be identical for all racks processed on the same machine tool and thus remain without effect. At any rate the racks are thus exactly reproducible and exactly identical with respect to each other.

A preferred embodiment of the multiple longitudinal traversing shed weaving loom according to the invention has lamellae combs arranged on a carrier or support and containing the shed-retaining elements. A positioning element in the form of a second rack extends over the weaving or fabric width and serves to position the lamellae of the related lamellae comb on said carrier. This embodiment is characterized by the first rack having a tooth pitch which corresponds to the tooth pitch of the second rack.

Preferably, the first and the second racks correspond to each other and are of the same design.

Thus, the same elements can be used for shedding as well as for positioning the lamellae. On the one hand, highest conformity of the lamellae pitch and of the pitch of the warp threads is thereby ensured, and thus, there is realized an optimally ordered run or course of the warp threads from the shedding rods to the weaving rotor. On the other hand, manufacture as well as operation of the multiple longitudinal traversing shed weaving loom according to the invention is made cheaper.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the weaving machine or loom has been shown as needed for those skilled in the art to readily understand the underlying principles and concepts of the present development, while simplifying the showing of the drawings. Turning attention now specifically to FIGS. 1 to 3, there has been schematically shown therein a lamellae comb arrangement or lamellae comb for a weaving rotor of a multiple longitudinal traversing shed weaving machine or loom. The lamellae comb arrangement comprises a carrier or support 1, a beat-up comb 2 and a guide comb 3, the two combs 2, 3 being mutually offset by essentially half a pitch or division with respect to one another. The construction and operation of a multiple longitudinal traversing shed weaving machine or loom containing a weaving rotor is properly assumed as being known to those skilled in the art and, therefore, is not here explained in any great detail; reference is, however, made in this regard to the aforementioned U.S. Pat. No. 4,291,729, granted Sep. 29, 1981.

In principle, any known weft insertion system can be used with a multiple longitudinal traversing shed weaving loom. The lamellae comb arrangement as shown in FIGS. 1 to 3 is not limited to a specific weft insertion system and is not specific for such a weft insertion system, and thus, there is no need to here consider such a weft insertion system.

Figure 3:
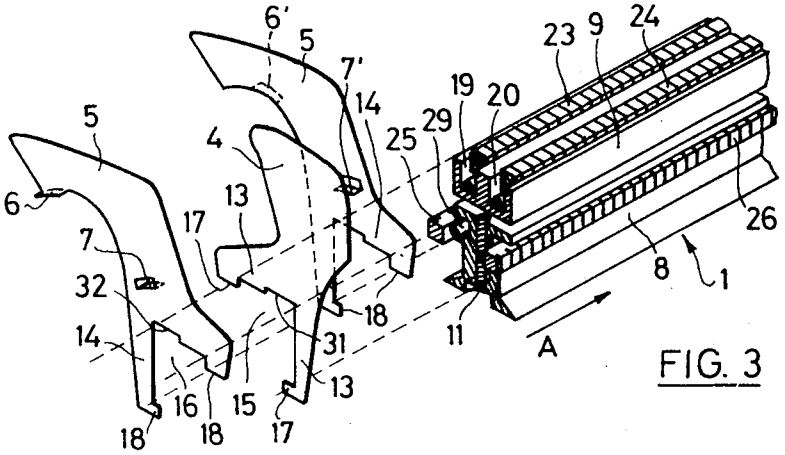
FIG. 3 is a schematic illustration in perspective exploded view of the carrier or support as shown in FIG. 1 showing three lamellae to be mounted thereon.
Figure 2:
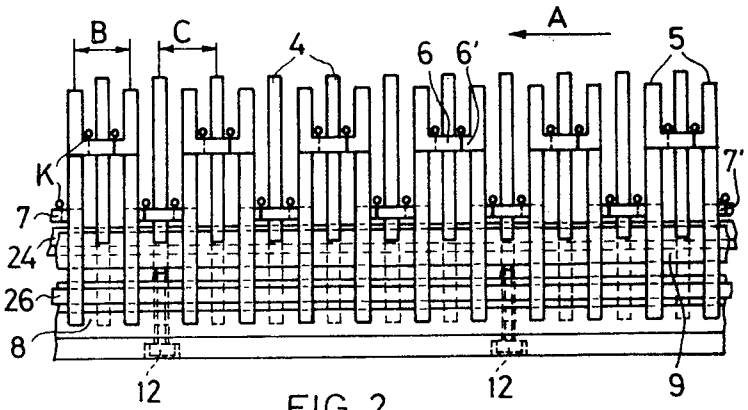
FIG. 2 is a view of the carrier and lamellae combs shown in FIG. 1 looking in the direction of the arrow II thereof.
Figure 1:
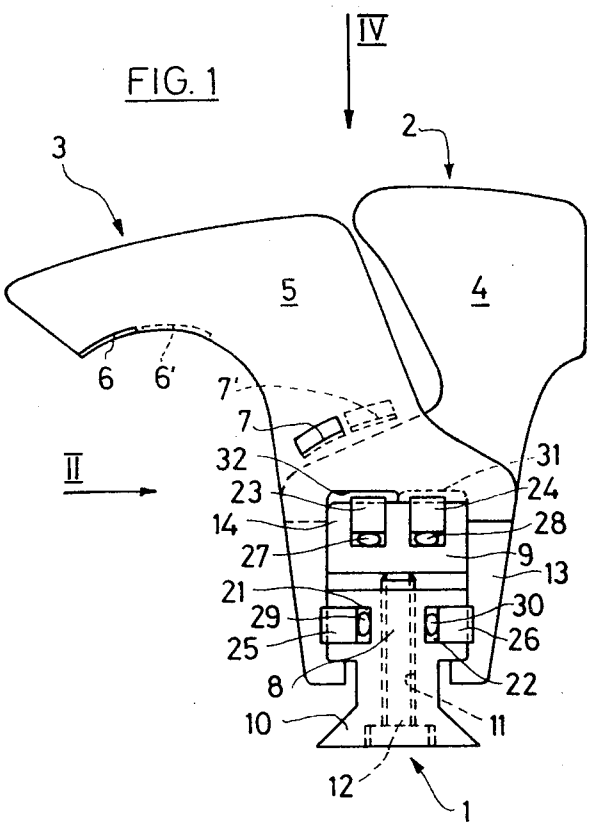
FIG. 1 is an end view, on an enlarged scale, of a carrier or support carrying two lamellae combs in a multiple longitudinal traversing shed weaving loom constructed according to the invention.

According to FIGS. 1 to 3, the beat-up comb 2 comprises beat-up lamellae or small plate members 4 serving to beat-up the weft threads, and the guide comb 3 comprises guide lamellae or small plate members 5 for the warp threads K. The guide lamellae or small plate members 5 are provided with shed-retaining elements which determine the upper shed position or lower shed position, respectively, of the warp threads K. By means of the shed-retaining elements the warp threads are retained over the entire wrap angle at the weaving rotor in their upper shed position or in their lower shed position, as the case may be.

FIG. 2 shows the individual lamellae or small plate members 4, 5 illustrated exaggerated in thickness; the so-called tube formed between two adjacent guide lamellae 5 is designated by reference character B, and the tube formed between two adjacent beat-up lamellae 4 is designated by reference character C. It will be seen that both of the lamellae combs 2 and 3 (see FIG. 1) containing the lamellae 4 and 5, respectively, are mutually offset or shifted by half a tube width. According to the illustration, two warp threads K are present in each tube of each of the two lamellae combs 2, 3. Thus, it will be seen that the two warp threads K in the tube B between two guide lamellae 5 are conjointly either in the upper shed position or in the lower shed position. In the tube C between two beat-up lamellae 4 one of the two warp threads K is in the upper shed position while the other one is in the lower shed position. Such representation corresponds to double stitch linen weaves.

The shed-retaining elements for the warp threads K are formed by laterally protruding projections or extensions provided at the guide lamellae 5. Each guide lamella 5 is provided with a first projection or extension 6 or 6', respectively, which serves as a shed-retaining element for the upper shed position and with a second projection or extension 7 or 7', respectively, which serves as a shed-retaining element for the lower or bottom shed position. The first projections 6, 6' are formed by a bent-over section located at an edge or marginal region of the guide lamellae 5. The second projections 7, 7' are formed by punching out a kind of window or window wing at three edges from the guide lamellae 5 and by bending the same over at the fourth edge thereof. Since the shed-retaining elements for the upper and for the lower shed positions are always arranged in different tubes, the first and second projections 6, 6' and 7, 7', respectively, each protrude to different sides away from the guide lamellae 5.

Each shed-retaining element is formed by two first projections 6, 6' or two second projections 7, 7' which are formed at the guide lamellae 5 bounding or defining the respective tube. The two projections respectively forming one shed-retaining element project towards each other, as shown in FIGS. 2 and 3, and are mutually offset in the warp direction which roughly corresponds to the direction of the arrow II in FIG. 1. The lamella comb 3 is thus composed of two kinds of guide lamellae 5: guide lamellae 5 having a first projection 6 extending opposite to the weft direction A and a second projection 7 extending in the weft direction A, and guide lamellae 5 having a first projection 6' extending in the weft direction A and a second projection 7' extending opposite to the weft direction A.

As shown, the carrier or support 1 for the lamellae combs 2 and 3 shown in FIG. 1 comprises two mutually parallel rails 8 and 9 which extend across the weaving or fabric width and one of which is provided with a dovetail 10. The dovetail 10 is intended to be inserted into a correspondingly configured slot or groove formed at the circumferential surface of the here not particularly shown weaving rotor. The rail 8 carrying the dovetail 10 is provided along its length with distributively arranged threaded bores 11 spaced from one another by about 3 to 10 cm. Into each of these threaded bores 11 there is screwed a sunk screw or threaded bolt 12, one end of which protrudes from the rail 8 and presses against the rail 9, as shown. By turning the screws 12 the distance between the two rails 8 and 9, and thus, the cross-section of the carrier or support 1 may be adjusted.

Each of the lamellae 4 and 5 has two mounting legs or limbs 13 and 14, respectively, which form a jaw or mouth 15 and 16, respectively, partially gripping around the mounting or support rails 8 and 9. The jaws 15 and 16 of the lamellae 4 and 5, respectively, are limited at the end of the respective mounting leg or limb 13 and 14 by a projection 17 and 18, respectively. The projections 17 and 18 are provided to lock into two diagonally oppositely situated edges provided at the two rails 8 and 9. The width of the jaws or mouths 15 and 16 and the cross-section of the rails 8, 9 are dimensioned such that with the screws 12 released, i.e. at a small mutual distance of the two rails 8 and 9, the lamellae 4 and 5 including the mounting or attachment legs or limbs 13, 14 can be slipped onto the rails 8, 9 and thereafter can be fixed by appropriately adjusting or tightening the screws 12. Each carrier 1 formed by the rails 8 and 9 carries two lamellae combs 2 and 3 (see FIG. 1) including beat-up lamellae 4 and guide lamellae 5 and which are offset from each other by half a pitch or width of the tube B or C.

Positioning of the lamellae 4, 5 on the rails 8 and 9 is accomplished by using rod-like elements which are arranged in parallel to the carrier or support 1 and which are provided with guide means for the lamellae. The pitch of the guide means corresponds to the desired pitch of the lamellae 4 and 5. The guide means are formed by the teeth of second racks which have the desired tooth pitch and possess a triangular or trapezoidal profile; the second racks are imbedded in the carrier 1.

As shown in the drawings, the rail 9 is provided with two parallel longitudinal grooves or channels 19 and 20 at the outer surface or face thereof which is adjacent to the inner edge of the mounting leg or limb 13 or 14 which extends perpendicular to the screws 12. The rail 8 comprises respective longitudinal grooves or channels 21 and 22 in each of the two side surfaces or faces which extend parallel to the screws 12. Each of the grooves or channels 19 to 22 is provided in order to accommodate a respective one of the racks 23 to 26 which extends over the entire length of the carrier or support 1, and thus, across the weaving or fabric width. A respective elastic insert or insert member, which in the illustrated example is constituted by an elastic or rubber cord 27 to 30 having a diameter of about 2 mm, is disposed between the bottom of each groove 19 to 22 and the associated rack 23 to 26.

A respective pair of racks 23, 26 and 24, 25 is provided for each lamellae comb 2 and 3, respectively (FIG. 1) and the lamellae 4 or 5, respectively, are each guided therein at the region of their projections 17 and 18, respectively. At the inner edge of the inner leg or limb which extends perpendicular to the screws 12, the lamellae 4, 5 each have a step or stepped portion 31 and 32, respectively, by means of which they extend from the exterior around the respective rack 24, 23 associated with the other lamellae 5 or 4, whereby no contact can be made with the teeth thereof which project from the carrier 1 to the outside.

The depth of the grooves 19 to 22, the height of the racks 23 to 26 and the height of the teeth thereof as well as the thickness of the elastic or rubber cords 27 to 30 are matched to each other such that the teeth of the racks 23 to 26 prior to mounting of the lamellae 4, 5 onto the carrier 1 slightly protrude past the side surfaces or faces of the rails 8 and 9 which are provided with the grooves 19 to 22. Thus, the lamellae 4, 5 are slipped on or mounted against the pressure of the elastic cords 27 to 30 which press the teeth of the racks 23 to 26 completely against and between the lamellae 4 and 5 which thus are always positively positioned.

Figure 4:
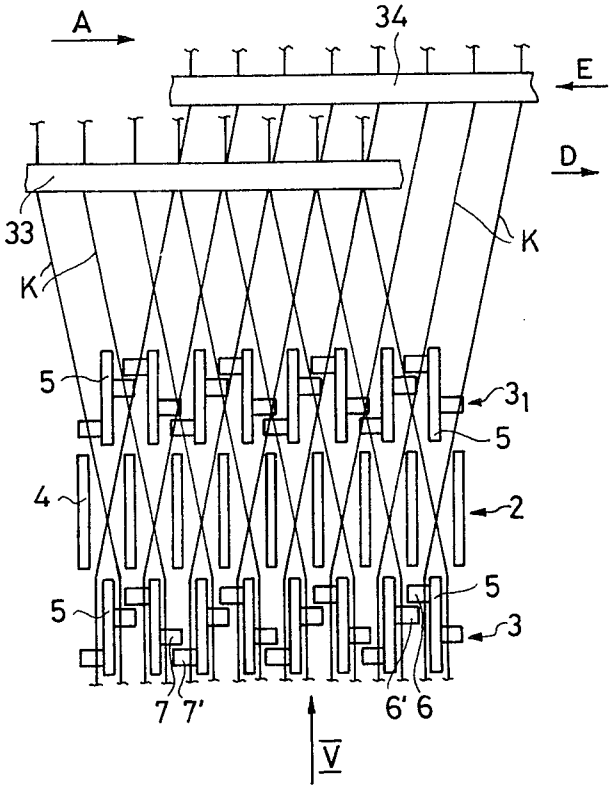
FIG. 4 is a schematic representation showing the arrangement of the carriers including the lamellae combs and the shedding rods as generally seen when looking in the direction of the arrow IV in FIG. 1.

FIG. 4 illustrates with reference to a schematically shown development view of two guide combs 3 and $3_1$ and a beat-up comb 2 arranged therebetween the introduction of the warp threads K into the lamellae combs 2, 3. There also will be clearly recognized the mutually overlapping projections 6, 6′ and 7, 7′, respectively, forming the shed-retaining elements. The warp threads K are guided in shedding rods and shed forming rods 33 and 34 which are arranged forwardly of the lamellae combs 2 and 3, and thus, forwardly of the weaving rotor as seen in the running or travel direction of the warp threads K which extend from the shedding rods 33 and 34 to the lamellae combs 2 and 3. The weaving rotor rotates such that the upper half of its outer surface moves away from the shedding rods 33 and 34 which, with respect to FIG. 1, implies a clockwise rotation. Again, the explanations are based upon, by way of example and not limitation, the double stitch linen weave shown in FIG. 2, i.e. each warp thread K is alternatingly located in the upper shed position or in the lower or bottom shed position from one guide comb to the other. If permitted by the warp density, there are thus only required two shedding rods 33, 34 which always move in opposite directions.

In accordance with the illustration in the drawing of FIG. 4, the guide comb 3 and the beat-up comb 2 are fully immersed into the warp threads K and the guide comb $3_1$ will then next immerse into the warp threads K. The warp threads K present in the upper shed position in the guide comb 3 will then assume the lower shed position and the warp threads K in the lower shed position will then assume the upper shed position.

To achieve that, the shedding rods 33, 34 have been displaced by conventional and therefore not particularly shown associated drive means such that the warp threads K assume the positions shown in the drawing. Due to this displacement the warp threads K guided by the shedding rod 33 are displaced to the left while the warp threads K guided by the shedding rod 34 are displaced towards the right until contacting the beat-up lamella 4 limiting the associated tube on the left and on the right, respectively. In this manner the guide lamella 5 may enter the group of warp threads K by passing through between two pairs of spread apart warp threads K. Each two of the spread apart warp threads K thus always arrive in a tube of the guide comb $3_1$ having the shed-retaining elements 6 and 6′ for the upper shed position while two others of the spread apart warp threads K arrive in a tube having the shed-retaining elements 7 and 7′ for the lower shed position. When the next following lamella comb enters into the warp threads K the shedding rods 33 and 34 are displaced in opposite directions, i.e. the shedding rod 33 to the right in the direction of the arrow D and the shedding rod 34 to the left in the direction of the arrow E.

Due to the scale of the drawing and to the exaggerated thickness with which the lamellae 4 and 5 are drawn as well as due to the exaggerated showing of the tube widths in the lamellae combs 2 and 3, the displacement travel path of the shedding rods 33 and 34 between the two warp thread positions appears substantially greater in FIG. 4 than it is in reality where the displacement travel path actually only amounts to a few millimeters, and generally, is distinctly below 10 mm, namely in the range of about 1 to 3 mm.

Figure 5:
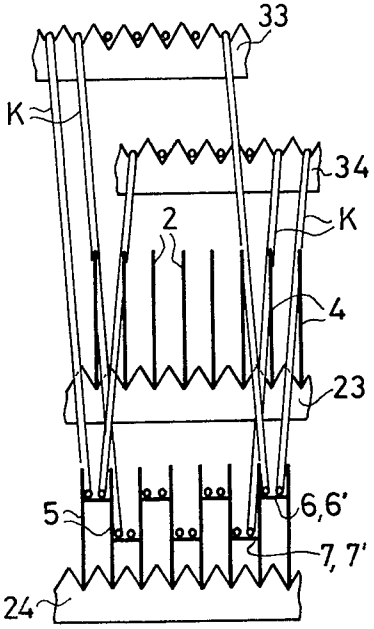
FIG. 5 is a schematic representation of a view of the arrangement shown in FIG. 4 looking in the direction of the arrow V in FIG. 4.

As shown in FIG. 5 of the drawings the shedding rods 33 and 34 are formed by first racks corresponding to the second racks 23 to 26 for positioning the lamellae 4 and 5 (see FIG. 3). Such racks are simple to manufacture and it is a specific advantage thereof that they do not possess a sum or summation error across the entire weaving width which would negatively affect the tooth pitch. While such errors would occur with high probability if the shedding rods 33 and 34 were provided with bores or eyelets in order to guide the warp threads K, it is to be appreciated, however, in the case of racks such errors are practically precluded. Only an error in the machine tool used for manufacturing the toothing could have an effect. However, this is very improbable, on the one hand, and, on the other hand, would probably still not have any effect because such an error would be the same in all racks of one manufacturing batch or lot.

In the distribution of the warp threads K as shown in the drawings in which two warp threads K are associated with each tube one respective warp thread K is positioned between two teeth when two first racks 33 and 34 are used as the shedding rods. When the total number of teeth of all shedding rods is a multiple of the number of warp threads K, obviously not all tooth spaces or gaps will be occupied by warp threads K. When there are n times as many teeth as warp threads K, a warp thread K will be present in only every nth tooth space or gap. In such case the pitch of the tooth bases or valleys could be selected correspondingly greater. However, it is of greater advantage to choose the same racks as used for the lamellae 4 and 5 as shedding rods and to occupy only every nth tenth with a warp thread K and to design, if desired, the respective tenth with a larger depth and/or width.

Figure 6:
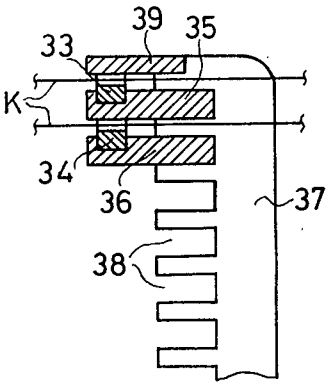
FIG. 6 is a cross-sectional view through two shedding rods or shed forming rods and their arrangement in the multiple longitudinal traversing shed weaving loom according to the invention.

FIG. 5 shows the first racks 33 and 34 in a schematic development view which is mainly intended to serve for understanding the arrangement. FIG. 6 shows the actual arrangement of the first racks 33 and 34 at the weaving loom. As shown in the drawings, each of the first racks 33, 34 extends across the weaving width and is firmly inserted into a carrier or support rod 35 or 36, respectively, which also extends across the weaving width. At one of their end faces the carrier rods 35 and 36 are connected to suitable drive means which, for example, may be formed by a driven or power take-off element of a dobby head or dobby or by a lever driven by an eccentric disk or an eccentric drum. Along the longitudinal edge remote from the first racks 33 and 34 the carrier rods 35 and 36 are slidably mounted in recesses or channels 38 which are formed in a fork or rake-like guiding member 37 and which are also distributed across the weaving or fabric width and which engage or grip the carrier rods 35 and 36 around said longitudinal edge thereof.

The carrier rods 35 and 36 are arranged on top of one another in such a manner that the bottom or lower surface of each carrier rod 35, 36 covers the teeth of the first rack 33 or 34 positioned immediately therebelow. The teeth of the topmost first rack, according to the drawing the first rack 33, is covered by a cover means in the form of a rail 39 carried by the guiding members 37. Thus, the warp threads K are prevented from jumping out of the teeth of the associated first rack 33 or 34, as the case may be. The guide members or guides 37 are provided with a number of recesses 38 corresponding to the possible total number of carrier rods as, for example, twelve recesses which are occupied by the correspondingly required number of carrier rods.

In the event that the first racks 33 and 34 are arranged in such a manner as to deflect the warp threads K out of their straight run or course, then the cover means for the teeth could be dispensed with. In case of an upwardly projecting arrangement of the teeth as shown in FIG. 6, then the first racks 33 and 34 would have to upwardly deflect the warp threads K between the last deflection roll forwardly of the racks and the weaving rotor, and correspondingly downwardly in case of a downwardly projecting tooth arrangement. Each of the warp threads K thus would be guided by the teeth while being deflected, and thus, also, could not break-off or jump out of the teeth.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A multiple longitudinal traversing shed weaving loom comprising:

a weaving rotor;

shed-retaining elements provided for said weaving rotor for holding warp threads over a predetermined path in selective upper and lower shed positions;

control means arranged forwardly of said weaving rotor with respect to a predetermined direction of travel of said warp threads;

said control means serving for the lateral deflection and allocation of each warp thread to a respective one of said shed-retaining elements determining either an upper shed or a lower shed;

said control means comprising shedding rods constituted by first racks extending in a predetermined weft direction and being displaceable through an adjustable stroke in said weft direction; and each of said first racks having rack teeth and tooth spaces therebetween which serve as guiding means for said warp threads.

2. The weaving loom as defined in claim 1, wherein:

said weaving rotor contains a carrier;

lamellae combs containing lamellae supported by said carrier and provided with said shed-retaining elements;

a second rack extending across a weaving width of the loom and serving to position said lamellae on said carrier;

said second rack containing teeth having a predetermined tooth pitch; and said first racks having a tooth pitch corresponding to the tooth pitch of said second rack.

3. The weaving loom as defined in claim 2, wherein:

said first and said second racks essentially correspond to each other and are essentially of the same construction.

4. The weaving loom as defined in claim 3, further including:

guide means in which said first racks are slidably guided;

said guide means being disposed across said weaving width of the loom; and cover means operatively associated with each first racks to cover the teeth thereof.

5. The weaving loom as defined in claim 4, wherein:

said guide means comprise carrier rods each carrying a respective one of said first racks;

said carrier rods being arranged on top of each other;

each of said carrier rods having oppositely disposed surfaces;

each of said carrier rods supporting at one surface thereof a related one of said first racks; and at least predetermined ones of said carrier rods covering by means of the other surface thereof the teeth of an adjacent first rack.

6. The weaving loom as defined in claim 2, wherein:

said lamellae supported by said carrier and contained by said lamellae combs define a predetermined number of tubes;

a preselected number of warp threads being drawn into each one of said tubes;

a predetermined number of said first racks each comprising a predetermined number of tooth spaces between the rack teeth thereof; and the number of warp thread-occupied tooth spaces between the rack teeth in each one of said predetermined number of first racks, in the case that said predetermined number of first racks is greater than the number of warp threads drawn into each one of said tubes, being defined by the product of the number of said occupied tooth spaces and the predetermined number of said first racks, which product is equal to the product of the predetermined number of tubes defined by said lamellae and the number of warp threads drawn into each one of said tubes.

7. The weaving loom as defined in claim 1, wherein:

each one of said first racks forms a predetermined number of tooth spaces between the rack teeth thereof;

said warp threads, when present in a number which is smaller than said predetermined number of tooth spaces between the rack teeth of said first track, occupying only a fraction of said predetermined number of tooth spaces of said first rack; and marking means to mark the occupied ones of said tooth spaces in said first rack.

8. The weaving loom as defined in claim 7, wherein:

said marking means comprise differently shaped rack teeth bounding each one of said occupied tooth spaces in said first rack.

* * * * *

UNITED STATES PATENT AND TRADEMARK OFFICE

CERTIFICATE OF CORRECTION

PATENT NO. : 4,487,233

DATED : December 11, 1984

INVENTOR(S) : Alois Steiner

It is certified that error appears in the above-identified patent and that said Letters Patent is hereby corrected as shown below:

Column 10, line 9, please delete "track" and insert --rack--

Signed and Sealed this

*Twenty-first* Day of *May 1985*

[SEAL]

*Attest:*

DONALD J. QUIGG

*Attesting Officer* *Acting Commissioner of Patents and Trademarks*